US005520087A

United States Patent [19]

Takamura et al.

[11] Patent Number: 5,520,087

[45] Date of Patent: May 28, 1996

[54] CONTROL DEVICE FOR HYDRAULICALLY OPERATED MACHINE

[75] Inventors: Fujitoshi Takamura; Yoshinao Haraoka, both of Hirakata, Japan

[73] Assignee: Kabushiki Kaisha Komatsu Seisakusho, Japan

[21] Appl. No.: 211,742

[22] PCT Filed: Jul. 9, 1993

[86] PCT No.: PCT/JP93/01268

§ 371 Date: Apr. 12, 1994

§ 102(e) Date: Apr. 12, 1994

[87] PCT Pub. No.: WO94/05917

PCT Pub. Date: Mar. 17, 1994

[30] Foreign Application Priority Data

Sep. 8, 1992 [JP] Japan ..... 4-239742

[51] Int. Cl.[6] ..... F15B 11/16

[52] U.S. Cl. ..... 91/532; 60/422

[58] Field of Search ..... 60/422; 91/514, 91/516, 532

[56] References Cited

U.S. PATENT DOCUMENTS 5,029,067 7/1991 Nishida et al. .
5,074,194 12/1991 Hirata et al. ..... 60/327

FOREIGN PATENT DOCUMENTS 33652 2/1983 Japan .
5928 1/1985 Japan .
187312 8/1988 Japan .
63-187311 8/1988 Japan .

*Primary Examiner*—F. Daniel Lopez
*Attorney, Agent, or Firm*—Welsh & Katz, Ltd.

[57] ABSTRACT

A control device for hydraulically operated machines for carrying out control to move a working unit with priority over other working units. A weight is added to each of the same manipulated amount of a plurality of operation levers 3, 4 in association with work type of M1 to M5 and the weights are stored in a memory of a controller 5 in association with the type of the operation levers 3, 4 and the work type. The work type M1 to M5 are selected by a switch 2. When the operation lever 3, 4 is manipulated and a work type is selected by the switch 2, the weight associated with the type of the manipulated operation lever 3, 4 and the selected work type M1 to M2 is read from the memory, and the read weight is added to a manipulated amount S1, S2 of the manipulated operation lever 3, 4. Then, not signals indicative of the manipulated amount S1, S2 of the operation lever 3, 4 but signals E, E' added with the weight which are indicative of the manipulated amount are outputted to control valves 7. This invention simply adds a simple-structured device to an existing hydraulic circuit to provide control so as to move a certain working unit with priority over other working units. Therefore, the cost of the device can be remarkably reduced.

1 Claim, 2 Drawing Sheets

| NON-PRIORITY \ PRIORITY | | M1 BOOM PRIORITY1 UP | M1 BOOM PRIORITY1 DOWN | M2 BOOM PRIORITY2 UP | M2 BOOM PRIORITY2 DOWN | M4 SWING PRIORITY1 | M5 SWING PRIORITY2 |
|---|---|---|---|---|---|---|---|
| BOOM | UP | — | — | — | — | C15 | C16 |
| | DOWN | — | — | — | — | C25 | C26 |
| ARM | DIGGING | C31 | C32 | C33 | C34 | C35 | C36 |
| | DUMP | C41 | C42 | C43 | C44 | C45 | C46 |
| BUCKET | DIGGING | C51 | C52 | C53 | C54 | C55 | C56 |
| | DUMP | C61 | C62 | C63 | C64 | C65 | C66 |
| SWING | | C71 | C72 | C73 | C74 | — | — |

| NON-PRIORITY \ PRIORITY | | M1 BOOM PRIORITY1 UP | M1 BOOM PRIORITY1 DOWN | M2 BOOM PRIORITY2 UP | M2 BOOM PRIORITY2 DOWN | M4 SWING PRIORITY1 | M5 SWING PRIORITY2 |
|---|---|---|---|---|---|---|---|
| BOOM | UP | — | — | — | — | $C_{15}$ | $C_{16}$ |
| | DOWN | — | — | — | — | $C_{25}$ | $C_{26}$ |
| ARM | DIGGING | $C_{31}$ | $C_{32}$ | $C_{33}$ | $C_{34}$ | $C_{35}$ | $C_{36}$ |
| | DUMP | $C_{41}$ | $C_{42}$ | $C_{43}$ | $C_{44}$ | $C_{45}$ | $C_{46}$ |
| BUCKET | DIGGING | $C_{51}$ | $C_{52}$ | $C_{53}$ | $C_{54}$ | $C_{55}$ | $C_{56}$ |
| | DUMP | $C_{61}$ | $C_{62}$ | $C_{63}$ | $C_{64}$ | $C_{65}$ | $C_{66}$ |
| SWING | | $C_{71}$ | $C_{72}$ | $C_{73}$ | $C_{74}$ | — | — |
FIG.2
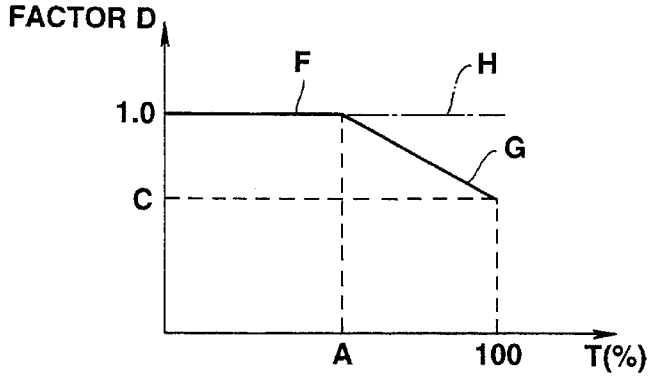
FIG.3
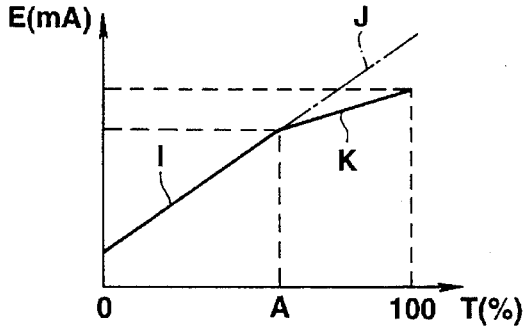
FIG.4

CONTROL DEVICE FOR HYDRAULICALLY OPERATED MACHINE

TECHNICAL FIELD

This invention relates to a control device for hydraulically operated machines including construction machineries such as hydraulic excavators, and more particularly to a control device for controlling each working unit according to a type of work to be done.

BACKGROUND ART

A hydraulic excavator has a plurality of working units such as a boom, an arm, a bucket, a swing mechanism and a travel mechanism. These units are operated by an operator who manipulates two operation levers in combination. The type of work to be done is different depending on the situation of a work site, and the order of priority of using these working units varies depending on the type of work. However, when a heavy load is applied to a working unit which is desired to be operated with priority over other working units, the operator has to manipulate the two control levers in a complicated way to decrease the load as well as to move that working unit with priority over the other working units. This is to lay an excessive burden upon the operator and requires him to be skillful. In view of the above circumstances, the applicant of this invention has filed a patent application (Japanese Patent Application No. 19769/1987) for a control device which adds a weight to a command value for a working unit which is desired to be moved with priority over other working units so that, even by naturally manipulating the levers, it can be moved faster than when being moved by a normal manipulation. The invention of this application has been put into practice.

However, the above-mentioned control device is intended to control a swash plate inclination angle of a hydraulic pump in addition to a valve opening degree of a flow rate control valve for controlling a flow rate of pressure oil supplied to hydraulic actuators such as hydraulic cylinders to drive the working units, and to comprehensively control the above-mentioned angle and opening degree depending on the priority order of the working units. In the case of this type of control device, it is necessary to decide at a stage of designing a hydraulic circuit that the control device is built in it and to design an exclusive hydraulic circuit. Therefore, the conventional control device cannot be installed in the existing hydraulic circuits at a later stage by way of so-called "after-installation".

Accordingly, there have been demanded for a cost reduction purpose a simply structured device which can be added to the existing hydraulic circuits so as to be able to control working units according to the order of priority.

SUMMARY OF THE INVENTION

This invention has been made in view of the above circumstances and is to provide a simply structured device which can be added to the existing hydraulic circuits so as to be able to control working units according to the order of priority.

In accordance with the present invention, there is provided a hydraulically operated machine including a plurality of hydraulic actuators disposed in association with a plurality of working units, for actuating the associated working units in accordance with a flow rate of supplied pressure oil, operation valves disposed in association with the plurality of hydraulic actuators, for supplying to the associated hydraulic actuators the pressure oil with a flow rate corresponding to an applied pilot pressure, a hydraulic pump for supplying a discharge pressure oil to the operation valves, operation levers disposed in association with the plurality of working units and, a control valve for receiving signals indicative of manipulated amounts of the operation levers, converting the inputted signals into the pilot pressure and applying the pilot pressure to the associated operation valves, characterized in that the hydraulically operated machine comprises:

storage means for giving a weight to respective same manipulated amount of the plurality of operation levers according to a work type and storing the weight in association with the type of the operation levers and the work type, selection means for selecting the work type, and means, when the operation lever is manipulated and the work type is selected by the selection means, for reading from the storage means the weight associated with the type of the manipulated operation lever and the selected work type, for adding the read weight to the manipulated amount of the manipulated operation lever and for outputting to the control valve a signal indicative of the manipulated amount being added with the weight.

According to the above configuration, it is sufficient by simply adding the above "storage means", "selection means" and "means for outputting to the control valve" to the hydraulic circuit of the existing hydraulically operated machines. These means can be easily added to the existing control panels and controllers. Then, the weight is given to respective same manipulated amounts of the plurality of operation levers according to the work type, and the weight is stored in the storage means in association with the type of operation lever and the work type. On the other hand, the work type selected by the selection means. When an operation lever is manipulated and a work type is selected by the selection means, a weight associated with the manipulated operation lever and the selected work type is read from the storage means, and the read weight is added to the manipulated amount of the manipulated operation lever. Further, not a signal indicative of the manipulated amount itself of the operation lever but a signal indicative of the weight-added manipulated amount is outputted to the control valve.

BRIEF DESCRIPTION OF THE DRAWINGS

FIG. 2 is a table showing the contents stored in a memory of the controller shown in FIG. 1;

FIG. 3 is a graph obtained as a result of conducting a prescribed processing based on the contents shown in FIG. 2 by the controller shown in FIG. 1; and FIG. 4 is a graph obtained as a result of conducting a prescribed processing based on the graph shown in FIG. 3 by the controller shown in FIG. 1.

BEST MODE FOR CARRYING OUT THE INVENTION

Figure 1:
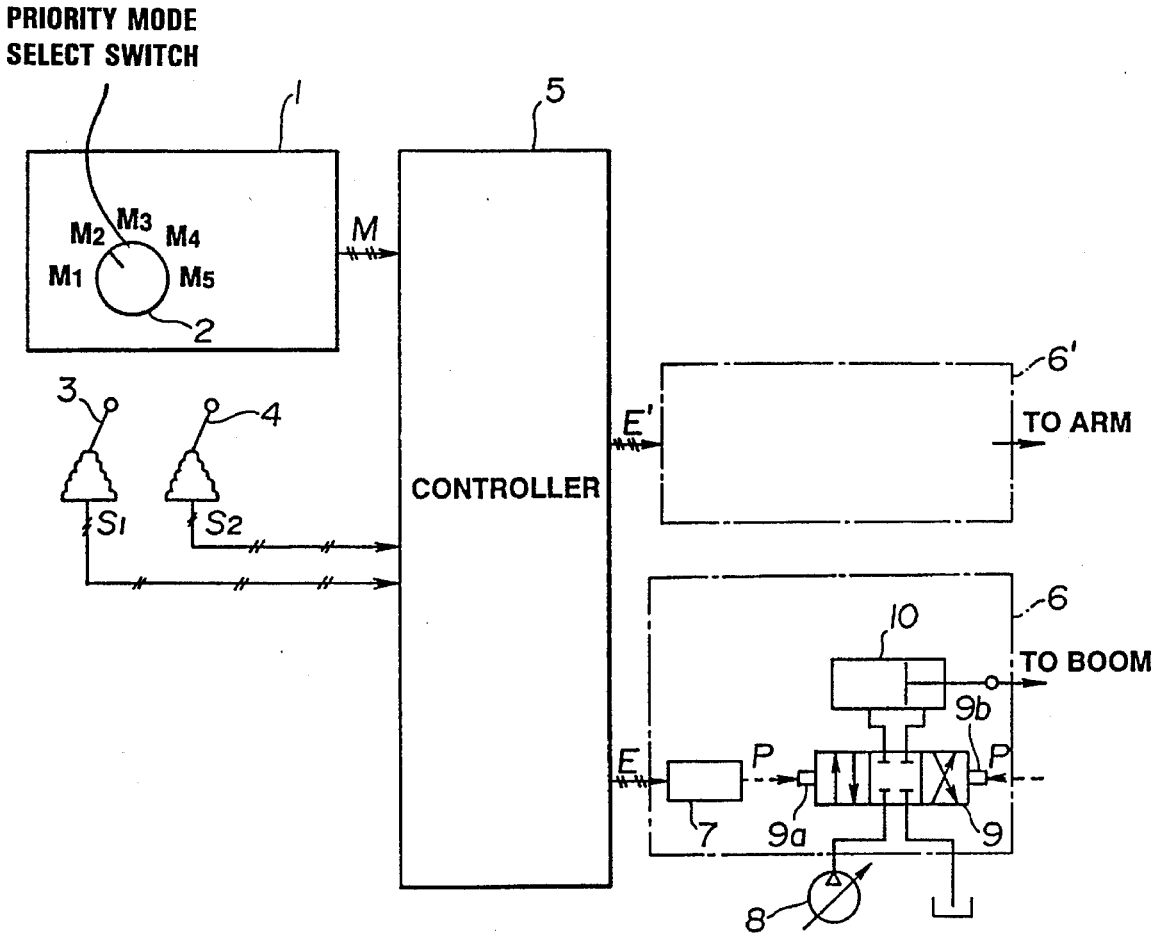
FIG. 1 is a block diagram showing the structure of an example of the control device for hydraulically operated machines according to this invention.

An example of the control device for hydraulically operated machines according to this invention will be described with reference to the attached drawings.

FIG. 1 shows an example where the control device of this invention is applied to a hydraulic excavator.

As shown in the drawing, the exemplified device roughly comprises a control panel 1 having a priority mode selection switch 2 for selecting priority mode M to be described afterward, left and right operation levers 3, 4 for actuating a plurality of working units including a boom, an arm, a bucket, a swing mechanism and a travel mechanism, a controller 5 for carrying out the processing to be described afterward, and hydraulic circuits 6, 6' . . . disposed in association with each working unit, for driving the working units according to the output of the controller 5. The hydraulic circuits 6, 6' are independently shown for convenience of explanation, however, they are fed with pressure oil from a common variable delivery hydraulic pump 8, and pipes for that purpose are connected mutually.

The hydraulic pump 8 is driven by an engine which is not shown, and a swash plate inclination angle is servo-controlled so that the number of revolutions of the engine becomes a targeted number of revolutions. The hydraulic circuit 6 is provided for driving the boom, and the discharge pressure oil of the hydraulic pump 8 is supplied to a hydraulic cylinder 10 through an operation valve 9 to actuate the boom. An electromagnetic proportional control valve 7 is a control valve for outputting pressure oil having a pilot pressure P corresponding to an electric signal E entered from the controller 5, and the pilot pressure oil is supplied to a pilot port 9*a* or 9*b* of the operation valve 9. When the pilot pressure oil acts on the pilot port 9*a* or 9*b*, the operation valve 9 supplies the pressure oil discharged from the hydraulic pump 8 to an extending side cylinder chamber or a retreating side cylinder chamber of the hydraulic cylinder 10 to lift the boom up or down. With the increase of the pressure P supplied to the pilot port 9*a*, 9*b*, a flow rate of the pressure oil supplied from the operation valve 9 to the hydraulic cylinder 10 increases and, in proportional to it, a speed of the boom lifting up or down increases. Therefore, the greater the electric signal E is, the faster a speed of the working unit becomes.

The hydraulic circuits 6' . . . associated with other working units, arm . . . , are also configured in the same way as the aforementioned hydraulic circuit 6, so that the moving speed of the arm . . . increase in proportion to the magnitude of the applied electric signals E' . . . .

The left and right operation levers 3, 4 are so-called electric levers, and the left lever 3 is disposed in association with the arm and the swing. According to the manipulated direction of the lever 3, the moving direction of the arm (digging direction, dump direction) and a swing direction are determined. The manipulated amount of the lever 3 determines the moving speed of the arm or the swing mechanism. An electric signal S1 indicative of such a type of the working unit, its moving direction and its manipulated amount is outputted from the lever 3 and applied to the controller 5. The right lever 4 is similarly disposed in association with the boom and the bucket. According to the manipulated direction of the lever 4, the moving direction of the boom (up direction, down direction) and the moving direction of the bucket (digging direction, dump direction) are determined. And the manipulated amount of the lever 4 determines the moving speed of the boom or the bucket. An electric signal S2 indicative of such a type of the working unit, its moving direction and its manipulated amount is outputted from the lever 4 and applied to the controller 5. A lever for the travel mechanism is not shown in the drawing. These operation levers may be disposed on the control panel 1.

With the priority mode selection switch 2 on the control panel 1, any one of five priority modes M1 to M5 can be selected arbitrarily according to the work type. The five modes are "boom priority 1" mode M1 for moving the boom faster with priority over the other working units, "boom priority 2" mode M2 for moving the boom faster with priority over the other working units, standard mode M3 for not giving priority to any of the working units, "swing priority 1" mode M4 for moving the swing mechanism faster with priority over the other working units, and "swing priority 2" mode M5 for moving the swing mechanism faster with priority over the other working units. An electric signal M indicative of the selected priority mode is applied to the controller 5.

The controller 5, according to the signals S1, S2 from the levers 3, 4 and the signal M from the selection switch 2, carries out the processing to be described below and generates the electric signals E, E' . . . to be applied to the electromagnetic proportional control valves 7 . . . of the hydraulic circuits 6, 6' . . . . The processing carried out by the controller 5 will be described with reference to FIG. 2 to FIG. 4.

FIG. 2 is a table showing the priority modes and correction factors C (to be described afterward) of each working unit in each priority mode, which is stored in the memory of the controller 5. The correction factors C are set in association with the priority modes, working units and moving directions of the working units, respectively. The correction factors C are within a range of $O<C<1$, and "-" in the table indicates a value 1 without correction. The standard mode M3 is not shown in the table because the correction factor C of each working unit is 1. Even in the same boom priority mode, the "boom priority 1" and the "boom priority 2" are for different types of works, so that their correction factors are different accordingly. The relation between the "swing priority 1" and the "swing priority 2" is also the same.

The correction factors C are factors indicative of the order of priority of the working units and, when the correction factor C of a working unit becomes relatively larger than the correction factors of the other working units, this working unit is operated with the priority over the other working units. The correction factors C are set as factors determined when a flow rate command value T (to be described afterward) is 100%.

Assume now that when the "boom priority 1" mode M1 is selected as the priority mode, a judgement is made in accordance with the content of the inputted signal S2 whether the boom is actuated in the up direction or down direction. And, the correction factor C corresponding to the judged result is read from the table. For example, when operation is made in the boom-lifting-up direction, the correction factors C31 to C71 of the leftmost column are read. Further, in accordance with the contents of the signals S1, S2, moving directions of the arm and the bucket are judged and, in accordance with the judged result, either of the correction factors C31, C41 and either of the correction factors C51, C61 are read.

In accordance with the signals S1, S2, the manipulated amount of each working unit is converted into the flow rate command value T, that is, the opening degree (%) T of the operation valve, in the engineering system of units.

Then, based on the read correction factors C and the flow rate command value T, the relation between the flow rate command value T and the correction factor D is determined as shown in FIG. 3. For example, since the correction factor of the boom which is a priority axis is 1 (at 100%), the correction factor D is determined to be a constant value 1 as indicated by F and H when the flow rate command value T is in the range of 0 to 100%. On the other hand, since the correction factor of the arm which is a non-priority axis is for example C31 and smaller than 1 (at 100%), the correction factor D is determined to be 1 up to a predetermined opening degree A and, after that point, linearly decreases to C31 as indicated by F and G. This characteristic of dropping the correction factor after the predetermined opening degree A is given because priority is desired when the lever is moved in a relatively large stroke (opening degree A or more), though priority is not required in a so-called fine area F. The opening degree A is set from the experiences at 50%, for example.

Then, the flow rate command value T is processed to be converted into the electric signal E (mA) in the engineering system of units. FIG. 4 shows the relation between the flow rate command value T and the electric signal E, in which I and J show a reference relation. By multiplying the electric signal indicated by I and J with the above factor D, an electric signal to be applied to each electromagnetic proportional control valve is determined. Since the correction factor D of the boom is 1 in the range of the opening degree of 0 to 100%, an electric signal E' is obtained as the proportional relation indicated by I and J. Therefore, the electric signal E' proportional to the manipulated amount of the lever is outputted to the electromagnetic proportional control valve of the hydraulic circuit 6' associated with the boom. On the other hand, the correction factor D of the arm is 1 in the range of the opening degree of 0 to A% and becomes I in the same way as the boom, however, since the correction factor D according to the above characteristic G is multiplied in the range of A to 100%, the electric signal E' is made to linearly decrease as indicated by K. This electric signal E' is outputted to the electromagnetic proportional control valve 7 of the hydraulic circuit 6 associated with the arm. The electric signals associated with the other working units are also generated in the same way and outputted to the electromagnetic proportional control valve of each hydraulic circuit.

Consequently, when the operator manipulates the operation lever 3 to actuate the boom and the manipulated amount exceeds the fine area, the electric signal E', which is outputted to the electromagnetic proportional control valve 7 associated with the arm, becomes smaller than the electric signal E which is outputted to the electromagnetic proportional control valve associated with the boom. Similarly, the electric signals, which are outputted to the electromagnetic proportional control valves associated with the bucket etc. of another non-priority axis, become smaller than the electric signal E which is outputted to the electromagnetic proportional control valve associated with the boom. More specifically, when the opening degree of the control valve 9 is A or more, the magnitude of the electric signal E' becomes smaller than a normal electric signal (an electric signal proportional to the manipulated amount of the lever). Therefore, the pressure P acting on the pilot ports 9*a*, 9*b* of the operation valve 9 becomes smaller than a normal level, and pressure oil with a less flow rate than a normal level is supplied from the control valve 9 to the hydraulic cylinder 10. Consequently, the moving speed of the arm becomes slow.

When the opening degree of the operation valve for the boom which is a priority axis is A or more, the magnitude of the electric signal E doers not differ from the normal electric signal and remains proportional to the manipulated amount of the lever. Therefore, the pressure acting on the pilot port of the associated operation valve is also proportional to the manipulated amount of the lever. However, the moving speed of the arm etc. of other non-priority axes is slower than the normal speed and, accordingly, discharge pressure oil from the hydraulic pump 8 is supplied from the operation valve to the hydraulic cylinder in a larger amount. Consequently, the boom is moved faster with priority over the other non-priority axes such as the arm.

As discussed above, according to the above example, even when the operator manipulates the lever naturally, the working unit which is selected and instructed through the switch 2 is moved faster with priority over the other working units, so that a burden upon the operator can be reduced greatly.

In the above example, the correction is made to provide a characteristic to reduce the electric current E with respect to the standard characteristic J as indicated by K in FIG. 4, however, it is possible to make correction to provide a characteristic to increase the electric current E conversely with respect to the priority axis with the non-priority axis determined as the standard characteristic J.

Besides, many of the existing hydraulic circuits have a structure in which the manipulated amount of the operation lever is outputted to a so-called PPC valve, from which a pilot pressure proportional to the manipulated amount is supplied to the pilot port of the operation valve 9. Therefore, "after-installation" can be made easily by replacing the PPC valve of the existing hydraulic circuit with the electromagnetic proportional control valve 7, placing the controller 5 between the operation levers 3, 4 and the electromagnetic proportional control valve 7, and adding the priority mode selection switch 2 to the control panel 1. Accordingly, a production cost can be remarkably reduced.

In the example, the priority modes are set to be five, however, the number of priority modes discretionary and the contents can also be set as desired. For example, it is possible to practice with the priority given to the arm and bucket, or the priority can be given to the travel mechanism. Some existing hydraulic circuit are arranged to vary the set pressure of a so-called LS valve so as to make the relation between the manipulated amount of the lever and the flow rate of the operation valve variable. Such mechanisms and examples may be suitably combined for more accurate control.

Further, in the example, the control device of this invention is employed to a hydraulic excavator but not limited to it. The control device can be employed to any hydraulically operated machines such as construction machineries, etc. when it is necessary to move any one of plural working units with priority over the other working units.

INDUSTRIAL APPLICABILITY

As described above, this invention simply adds a simple-structured device to an existing hydraulic circuit to provide control so as to move a certain working unit with priority over other working units. Therefore, costs for realizing such control can be remarkably reduced.

We claim:

1. A hydraulically operated machine comprising a plurality of hydraulic actuators disposed in association with a plurality of working units, each for actuating an associated one of the working units in accordance with a flow rate of supplied pressure oil, operation valves disposed in association with the plurality of hydraulic actuators, each for supplying pressure oil with a flow rate corresponding to an applied pilot pressure to an associated one of the hydraulic actuators, a hydraulic pump for supplying discharge pressure oil to the operations valves, a plurality of operation levers disposed in association with the plurality of working units and control valves for receiving signals indicative of a manipulated amount of an operation lever, converting the signal into the pilot pressure and applying the pilot pressure to an associated one of the operation valves, said hydraulically operated machine including a control device having:

storage means for giving a weight to each of said manipulated amount of the plurality of operation levers according to type of works and storing correction coefficients corresponding to the weights in association with the type of the operation levers and the type of works;

selection means for selecting a work type by manual operation and, in response to the manual selection operation, for outputting a selection signal indicative of the selected work type; and means, when two or more of the operation levers are manipulated and manipulated amount signals indicative of the manipulated amount are input from two or more of the manipulated operation levers and the selection signal indicative of the work type is input from the selection means, for reading from the storage means the correction coefficients associated with the type of the manipulated operation lever and the selected work type on the basis of the input manipulated amount signals and the selection signal, the correction coefficient decreasing proportionally as the manipulated amount varies from the predetermined level to a maximum level, for multiplying the read correction coefficients with the input manipulated amount signals for each type of the operation levers only when the manipulated amount exceeds a predetermined level and for outputting to associated ones of the control valves the manipulated amount signals being multiplied by the correction coefficients.

* * * * *